United States Patent [19]

Schmitz-Montz

[11] Patent Number: 4,627,795

[45] Date of Patent: Dec. 9, 1986

[54] PISTON ASSEMBLY FOR A COMPRESSOR OR THE LIKE

[75] Inventor: Hans-Helmut Schmitz-Montz, Cologne, Fed. Rep. of Germany

[73] Assignees: Linde Aktiengesellschaft, Wiesbaden, Fed. Rep. of Germany; Atlas Copco Aktiebolag of Nacka, Stockholm, Sweden

[21] Appl. No.: 480,114

[22] Filed: Mar. 29, 1983

[30] Foreign Application Priority Data

Mar. 30, 1982 [DE] Fed. Rep. of Germany ..... 3211763

[51] Int. Cl.[4] ..... F04B 3/00; F04B 39/00

[52] U.S. Cl. ..... 417/267; 417/534; 92/162 R

[58] Field of Search ..... 417/267, 521, 534, 273; 92/162 R, 168

[56] References Cited

U.S. PATENT DOCUMENTS

| | | | |
|---|---|---|---|
| 159,533 | 2/1875 | Westinghouse | 417/267 |
| 2,449,930 | 9/1948 | Davey | 92/168 |
| 2,878,990 | 3/1959 | Zürcher | 92/162 R |
| 2,991,003 | 7/1961 | Petersen | 417/267 |
| 3,035,879 | 5/1962 | Hänny et al. | 92/162 R |
| 4,087,209 | 5/1978 | Ma'hig et al. | 417/521 |
| 4,111,609 | 9/1978 | Braun | 417/267 X |
| 4,313,714 | 2/1982 | Kubeczka | 417/273 |

*Primary Examiner*—Cornelius J. Husar
*Assistant Examiner*—Peter M. Cuomo
*Attorney, Agent, or Firm*—Karl F. Ross; Herbert Dubno

[57] ABSTRACT

A tandem piston arrangement for a compressor, especially for a dry-running compressor for the high pressure compression of gases such as oxygen, has one piston of the common rod form as a guide piston with piston and guide rings in engagement with the respective cylinder, and at least one other piston as a contactless piston. By thus moving the guide point of the rod with the contactless piston, the length of any vibratile portion of the rod carrying the contactless piston remains constant during reciprocation of the assembly and the vibratile natural frequency thus does not change during operation.

5 Claims, 1 Drawing Figure

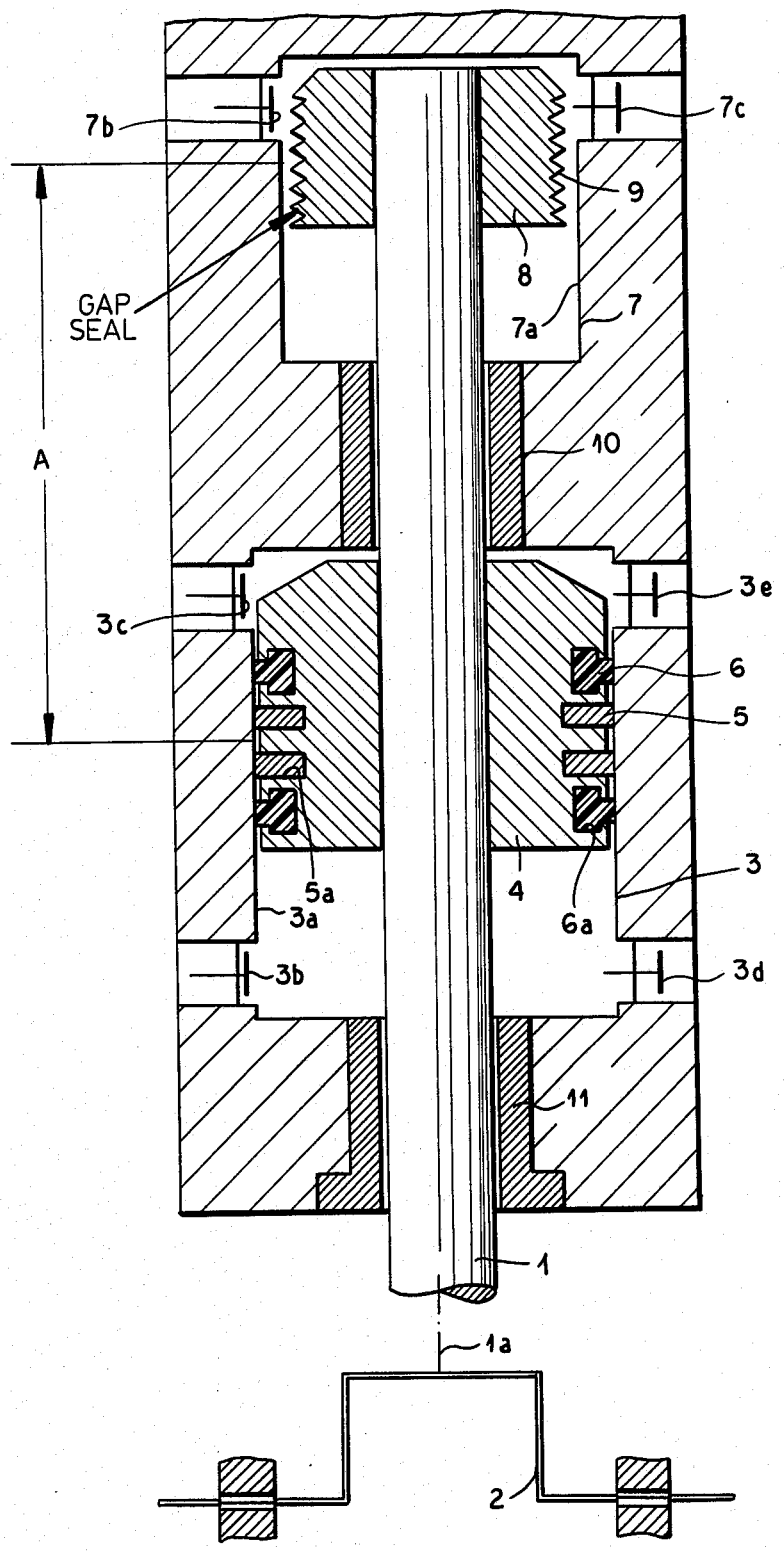
7b
7c
9
8
GAP
SEAL
7a
7
A
10
3e
3c
6
5
5a
4
3
3a
6a
3b
3d
11
1
1a
2

PISTON ASSEMBLY FOR A COMPRESSOR OR THE LIKE

FIELD OF THE INVENTION

My present invention relates to a tandem piston arrangement for compressors e. g. for dry compressors adapted to build up high gas pressures, and more particularly to a compressor having a tandem piston arrangement whereby two pistons are carried by a single shaft for operation by a single actuator.

BACKGROUND OF THE INVENTION

In certain piston-and-cylinder applications, it is frequently convenient to provide a tandem piston assembly in which two axially spaced effective surfaces, e.g. of different effective area, can be reciprocated on a common carrier in respective cylinders or working chambers.

This is the case, for example, in piston-type compressors using a stepped piston, i.e. a single body having a large diameter portion and a small diameter portion defining the respective surface areas and effective in respective chambers to compress a gas therein, e.g. for two-stage compression. In other words, the gas compressed by one of the pistons can be fed into the chamber of the other for increased compression.

Such stepped pistons are provided with piston rings and guide rings which mechanically bear upon the walls of the respective cylinders, serve to seal the clearance between the piston and the cylinder wall against leakage of gas, and of course, are subject to wear.

The problem is especially pronounced in so-called dry-running compressors, i.e. compressors in which the seal between each piston and the respective cylinder wall is not lubricated by a liquid. In this case, the pressure differential along the length of the piston is limited by the mechanical properties of the sealing ring and, of course, varies with wear of the sealing ring.

Furthermore, the pressure differential across the sealing ring has an effect on the mechanical properties and stability thereof since, by subjecting the sealing ring to elevated pressures, one applies stress which tends to increase the danger of rupture or bring about added wear.

As a consequence, to avoid rupture of the piston ring by overstressing of the latter, the pressure differential across the ring, especially in the high pressure stages of a dry-running compressor must be limited and this, for a given output pressure, means that the number of stages to achieve the desired pressure level must be increased.

Since an increased number of stages means increased wear, the maintenance activity associated with such compressors is considerable. Furthermore, as the number of stages increases, the energy losses increase and the construction becomes increasingly complex.

Both initial construction and operation, therefore, may be unduly complicated by the need for a large number of operative stages.

Mention may also be made of the fact that contactless pistons have been provided heretofore in the compressor art as well. In this case, the guiding of the piston rod utilizes a fixed guide bushing, sleeve or the like, disposed below the cylinder chamber. While here problems with piston rings are eliminated, this approach introduces an entirely different array of problems resulting from the manner in which the piston rod is guided and, indeed an insufficiency in the ability to properly guide the piston rod so as to avoid vibration or oscillation of the piston and the portion of the rod carrying the piston beyond the guide.

Since the piston rod is a spring with respect to transverse forces and the piston itself is a mass free to move laterally at the end of this rod, the entire assembly constitutes a vibratile element whose effective length varies as the piston rod moves with respect to the fixed guide, thereby changing the natural or resonance frequency and creating vibration problems which ultimately are detrimental to the guide and to the compressor as a whole. Accordingly, the use of sealless or contactless pistons under circumstances described has not successfully replaced the use of piston-ring systems in spite of the fact that these latter systems involve substantial problems.

OBJECT OF THE INVENTION

It is the principal object of the present invention, therefore, to provide a tandem piston assembly, e.g. for use in a compressor, whereby the foregoing disadvantages are obviated.

Another object of the invention is to provide a piston-type compressor permitting the multistage compression of a gas to especially high pressures which is of simple and economical construction and is subject to less wear than earlier systems, and yet is also free from problems encountered with fixed-guide assemblies and piston-ring assemblies.

Still another object of this invention is to provide an improved tandem piston assembly and compressor using same which is economical to manufacture and can be operated with low maintenance and energy cost.

SUMMARY OF THE INVENTION

These objects and others which will become apparent hereinafter are attained, in accordance with the present invention, with a tandem piston assembly for a compressor which comprises, on a common shaft, a plurality of working pistons, each received in a respective working cylinder to compress the gas to respective pressures therein in a multistage compression operation, at least one of these pistons being provided as a guide piston with piston and guide rings engaging the wall of the respective cylinder while at least one other piston is formed as a contactless piston within its cylinder, i.e. always defines a clearance with its cylinder wall.

Naturally within this definition, the piston assembly can comprise two pistons, one of which is provided with the piston and guide rings, while the other is a contactless piston. When three pistons are provided on the common rod, one piston can be provided with the piston and guide rings while the other two can be contactless pistons, or two pistons can be provided with piston and guide rings while one is a contactless piston. As the number of pistons on the common rod increases, any combination can be provided. For example, if n represents the number of pistons in the common rod, and m represents the number of pistons provided with piston and guide rings (m being an integer greater than 0 and less than n), the number of pistons operating in a contactless mode will be equal to $p=n-m$ where p is an integer greater than 0 and less than n.

Since at least one piston operates in a contactless mode, this piston can operate with an especially high pressure gradient across it and, indeed, a pressure differential far exceeding the maximum considered acceptable for an equivalent piston-ring piston where high pressure differentials may damage the ring.

To the extent that high pressure differentials can be sustained by such pistons, correspondingly high pressures can be built up by them and hence the need for additional stages to build up high pressures is reduced.

Furthermore, since each contactless piston is associated with at least one piston provided with piston rings and guide rings on the common piston rod, the latter piston serves as a movable guide for the rod, and hence the free length between the guide and the possibly vibrating mass of the contactless piston remains constant. This eliminates variation in the natural vibratile frequency and permits designing the compressor so that resonance conditions are avoided. As a practical matter, it is difficult, if not impossible, to design a compressor to avoid resonance conditions when the natural frequency changes as in earlier contactless piston systems.

According to a feature of the invention, the piston is oriented in an upright manner with the guide piston being disposed below the contactless piston.

Advantageously the guide piston operates in a relatively low pressure range of the compressor while the contactless piston operates at a high pressure range thereof. This ensures that the piston and guide rings will be minimally stressed by the pressure differential. The guide piston, therefore, can be considered to provide for the precompression of the gas.

Furthermore, it has been found to be advantageous to provide the guide piston as a piston of larger diameter than the contactless piston to permit the gases compressed by the pistons to be raised to different pressures.

To further prevent stresses upon the contactless piston resulting from the high pressure differential across the length thereof, I have found it to be advantageous to provide between the contactless piston and the cylinder wall serving same with clearance, a metal labyrinth seal.

BRIEF DESCRIPTION OF THE DRAWING

The above and other objects, features and advantages of the present invention will become more readily apparent from the following description, reference being made to the accompanying drawing in which the sole FIGURE is a diagrammatic axial cross-sectional view illustrating a compressor according to the invention.

SPECIFIC DESCRIPTION

In the drawing I have shown a piston rod 1 which can be connected to a crankshaft 2, shown in highly diagrammatic form as represented by the dot-dash line 1*a*. The cranks haft 2 may be rotated by any appropriate drive means such as an electric motor, an internal combustion engine or the like.

The housing in which the piston rod 1 is displaceable defines a lower cylinder 3 within which the rod carries a guide piston 4 which is provided with externally open grooves 5*a* and 6*a* receiving, respectively piston rings 5 and guide rings 6. These rings ride on the inner surface 3*a* of the cylinder. The piston rings 5 can be composed of a low-friction sealing material such as polytetrafluoroethylene, and can be urged outwardly by a metal ring (not shown) while the guide rings 6 can be composed of sintered metal impregnated with graphite or molybdenum disulfide or the like and can be of the split-ring type.

Suffice it to say these pistons and guide rings provide guidance for the rod 1 so that the latter moves axially without lateral play.

The upper end of the rod 1 extends into an upper cylinder 7 of smaller diameter than the lower cylinder 3 and carries a contactless piston 8. The term "contactless" is here used to indicate that there is no lateral contact between the piston 8 and the wall 7*a* of the cylinder 7. However, between the piston 8 and the cylinder wall 7*a*, a metal labyrinth seal 9 is provided. Sleeve-type seals of any conventional piston-rod-seal type can be provided at the lower end of each of the cylinders, as shown at 10 and 11.

Air drawn into cylinder 3 can be precompressed therein and forced into a cylinder such as the cylinder 7 of another piston assembly (not shown) for multistage compression while the air fed to the cylinder 7 can be supplied from another precompression stage. To this end, both cylinders are provided with intake valves 3*b* and 3*c* or 7*b* and with discharge valves 3*d*, 3*e* or 7*c*.

As shown, the two pistons 4 and 8 have different diameters allowing the compression of gases in the respective cylinders to different pressures, the metal labyrinth seal 9 permitting especially high pressure differentials across the length of the piston 8.

The arrow A represents the potential oscillatory length of the mass of the piston 8 at the end of the rod 1. Since this represents the unsupported length and remains constant as the piston reciprocates, it should be apparent that the oscillatory system represented by the mass of piston 8 and the length A remains constant and hence defines a single natural frequency. The system is operated to avoid this natural frequency and hence minimize vibration. Utilizing the apparatus shown in a dry compressor for the compression of oxygen, pressures over 200 bar can be obtained.

I claim:

1. A piston compressor comprising housing means including a plurality of axially spaced cylinders having respective cylindrical walls, and a piston assembly reciprocatable in said cylinders, said assembly comprising a piston rod and respective pistons secured to said rod in axially spaced relationship and each received in a respective one of said cylinders for compressing gas therein, guide piston means formed by at least one of said pistons constituted as a guide piston and being provided with piston and guide rings slidably engaging a wall of the respective cylinder, at least one other of said pistons being provided as a contactless piston maintaining a clearance with the wall of the respective cylinder, said guide piston means constituting the sole guiding means reciprocation of said assembly in said housing means, said rod being received with clearance over its entire length within said housing whereby said assembly is unsupported except by said guide piston means.

2. The compressor defined in claim 1 wherein said guide piston and the respective cylinder operates for relatively low pressure compression of gas whereas said contactless piston and the respective cylinder operates for comparatively high pressure compression of gas.

3. The compressor defined in claim 1 wherein said pistons are of different diameter.

4. The compressor defined in claim 3 wherein said guide piston has a larger diameter than said contactless piston.

5. The compressor defined in claim 1 wherein said contactless piston is provided with a metal labyrinth seal juxtaposed with the wall of the respective cylinder.

* * * * *